US009322303B2

(12) United States Patent
Kobayashi et al.

(10) Patent No.: US 9,322,303 B2
(45) Date of Patent: Apr. 26, 2016

(54) VARIABLE VALVE TIMING CONTROL UNIT

(71) Applicant: AISIN SEIKI KABUSHIKI KAISHA, Kariya-shi (JP)

(72) Inventors: Masaki Kobayashi, Okazaki (JP); Masaaki Kaneko, Nukata-gun (JP)

(73) Assignee: AISIN SEIKO KABUSHIKI KAISHA, Kariya-Shi, Aichi-Ken (JP)

( * ) Notice: Subject to any disclaimer, the term of this patent is extended or adjusted under 35 U.S.C. 154(b) by 106 days.

(21) Appl. No.: 14/460,816

(22) Filed: Aug. 15, 2014

(65) Prior Publication Data

US 2015/0075459 A1 Mar. 19, 2015

(30) Foreign Application Priority Data

Sep. 19, 2013 (JP) ..... 2013-194470

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34426* (2013.01); *F01L 2001/34453* (2013.01); *F01L 2001/34466* (2013.01)

(58) Field of Classification Search
CPC ..... F01L 1/3442; F01L 2001/34466; F01L 2001/34423; F01L 2001/34426; F01L 2001/34453
USPC ..... 123/90.15, 90.17
See application file for complete search history.

(56) References Cited

U.S. PATENT DOCUMENTS 6,308,672 B1 10/2001 Lichti et al.
8,171,904 B2 * 5/2012 Watanabe ..... F01L 1/3442 123/90.15
2005/0028773 A1 2/2005 Komaki
2010/0139593 A1 6/2010 Takemura

FOREIGN PATENT DOCUMENTS

DE 10 2008 044 327 A1 6/2009
EP 2 256 309 A1 12/2010
EP 2 372 118 A2 10/2011
JP 2004-245074 A 9/2004
JP 2006-170024 A 6/2006

OTHER PUBLICATIONS

European Search Report issued Mar. 24, 2015, by the European Patent Office, in corresponding European Patent Application No. 14184884.6 (4 pages).

* cited by examiner

*Primary Examiner* — Ching Chang
(74) *Attorney, Agent, or Firm* — Buchanan Ingersoll & Rooney PC

(57) ABSTRACT

A variable valve timing control unit includes an intake-side variable valve timing control apparatus, an exhaust-side variable valve timing control apparatus, an intake-side phase control valve selectively performing supply and discharge of fluid relative to an advanced angle fluid passage and a retarded angle fluid passage of the intake-side variable valve timing control apparatus, an exhaust-side phase control valve selectively performing supply and discharge of the fluid relative to the advanced angle fluid passage and the retarded angle fluid passage of the exhaust-side variable valve timing control apparatus, and a single lock control valve controlling supply and discharge of the fluid relative to unlock fluid passages of the respective intake-side variable valve timing control apparatus and the exhaust-side variable valve timing control apparatus.

7 Claims, 10 Drawing Sheets

VARIABLE VALVE TIMING CONTROL UNIT

CROSS REFERENCE TO RELATED APPLICATIONS

This application is based on and claims priority under 35 U.S.C. §119 to Japanese Patent Application 2013-194470, filed on Sep. 19, 2013, the entire content of which is incorporated herein by reference.

TECHNICAL FIELD

This disclosure generally relates to a variable valve timing control unit.

BACKGROUND DISCUSSION

A known variable valve timing control unit which controls an intake timing of an intake valve of an internal combustion engine and an exhaust timing of an exhaust valve of the internal combustion engine independently from each other is disclosed in JP2004-245074A (which will be referred to as Patent reference 1). The known variable valve timing control unit disclosed in Patent reference 1 includes variable valve timing control apparatuses (corresponding to variable valve apparatuses of Patent reference 1) provided at an intake camshaft and an exhaust cam shaft, respectively. The known variable valve timing control unit includes a first control valve hydraulically controlling a phase of each of the variable valve timing control apparatuses and a second control valve hydraulically releasing a lock pin of a lock mechanism (which corresponds to a lock pin mechanism of Patent reference 1) of each of the variable valve timing control apparatuses.

That is, according to Patent reference 1, two of the first control valves are provided for controlling the phase of the variable valve timing control apparatus at an intake side and the phase of the variable valve timing control apparatus at an exhaust side, respectively. In addition, two of the second control valves are provided for releasing the lock of the lock mechanism of the variable valve timing control apparatus at the intake side and the lock of the lock mechanism of the variable valve timing control apparatus at the exhaust side, respectively.

Another known variable valve timing control unit which controls the intake timing of the intake valve of the internal combustion engine and the exhaust timing of the exhaust valve of the internal combustion engine independently from each other is disclosed in JP2006-170024A (which will be referred to as Patent reference 2). The known variable valve timing control unit disclosed in Patent reference 2 includes variable valve timing control apparatuses provided at an intake camshaft and an exhaust cam shaft, respectively. The known variable valve timing control unit includes control valves each of which hydraulically controls a phase of the corresponding variable valve timing control apparatus and hydraulically controls a lock pin of a lock mechanism of the corresponding variable valve timing control apparatus.

The known variable valve timing control unit disclosed in Patent reference 2 includes the two control valves for the two variable valve timing control apparatuses, respectively. Each of the control valves includes functions of controlling the phase and controlling the lock mechanism, corresponding to an operation position of a spool of the control valve.

According to each of Patent references 1 and 2, an opening/closing timing of an intake valve and an opening/closing timing of an exhaust valve are changed reflecting a rotational speed of an internal combustion engine and/or temperatures of the internal combustion engine, for example. As a result, a fuel-efficient operation is achieved.

However, in Patent reference 1, the two control valves for the phase control and the two control valves for the lock control are provided corresponding to the two variable valve control apparatuses. That is, the four valves are needed in total, which leads to an increase in the number of parts and an increase in size of the system.

In addition, Patent reference 2 includes the two control valves for the respective two variable valve timing control apparatuses, and each of the control valves includes the functions of the phase control and the lock mechanism control. According to Patent reference 2, the number of the parts is reduced, however, each of the control valves includes a complicated configuration and is increased in size.

A need thus exists for a variable valve timing control unit which is not susceptible to the drawback mentioned above.

SUMMARY

According to an aspect of this disclosure, a variable valve timing control unit includes an intake-side variable valve timing control apparatus and an exhaust-side variable valve timing control apparatus. Each of the intake-side variable valve timing control apparatus and the exhaust-side variable valve timing control apparatus includes a driving-side rotation member which synchronously rotates with a crank shaft of an internal combustion engine, a driven-side rotation member arranged coaxially with the driving-side rotation member, a lock member which engages from one of the driving-side rotation member and the driven-side rotation member to the other of the driving-side rotation member and the driven-side rotation member for establishing an engaged state of the lock member so that the driving-side rotation member and the driven-side rotation member are in an integral rotation state, an advanced angle fluid passage allowing supply of fluid to an advanced angle chamber formed between the driving-side rotation member and the driven-side rotation member, a retarded angle fluid passage allowing supply of the fluid to a retarded angle chamber formed between the driving-side rotation member and the driven-side rotation member, an unlock fluid passage allowing supply of the fluid for releasing the engaged state of the lock member, and the driven-side rotation member of the intake-side variable valve timing control apparatus being connected to an intake cam shaft of the internal combustion engine, the driven-side rotation member of the exhaust-side variable valve timing control apparatus being connected to an exhaust cam shaft of the internal combustion engine. The variable valve timing control unit includes an intake-side phase control valve selectively performing supply and discharge of the fluid relative to the advanced angle fluid passage of the intake-side variable valve timing control apparatus and relative to the retarded angle fluid passage of the intake-side variable valve timing control apparatus, an exhaust-side phase control valve selectively performing supply and discharge of the fluid relative to the advanced angle fluid passage of the exhaust-side variable valve timing control apparatus and relative to the retarded angle fluid passage of the exhaust-side variable valve timing control apparatus, and a single lock control valve controlling supply and discharge of the fluid relative to the unlock fluid passages of the respective intake-side variable valve timing control apparatus and the exhaust-side variable valve timing control apparatus.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
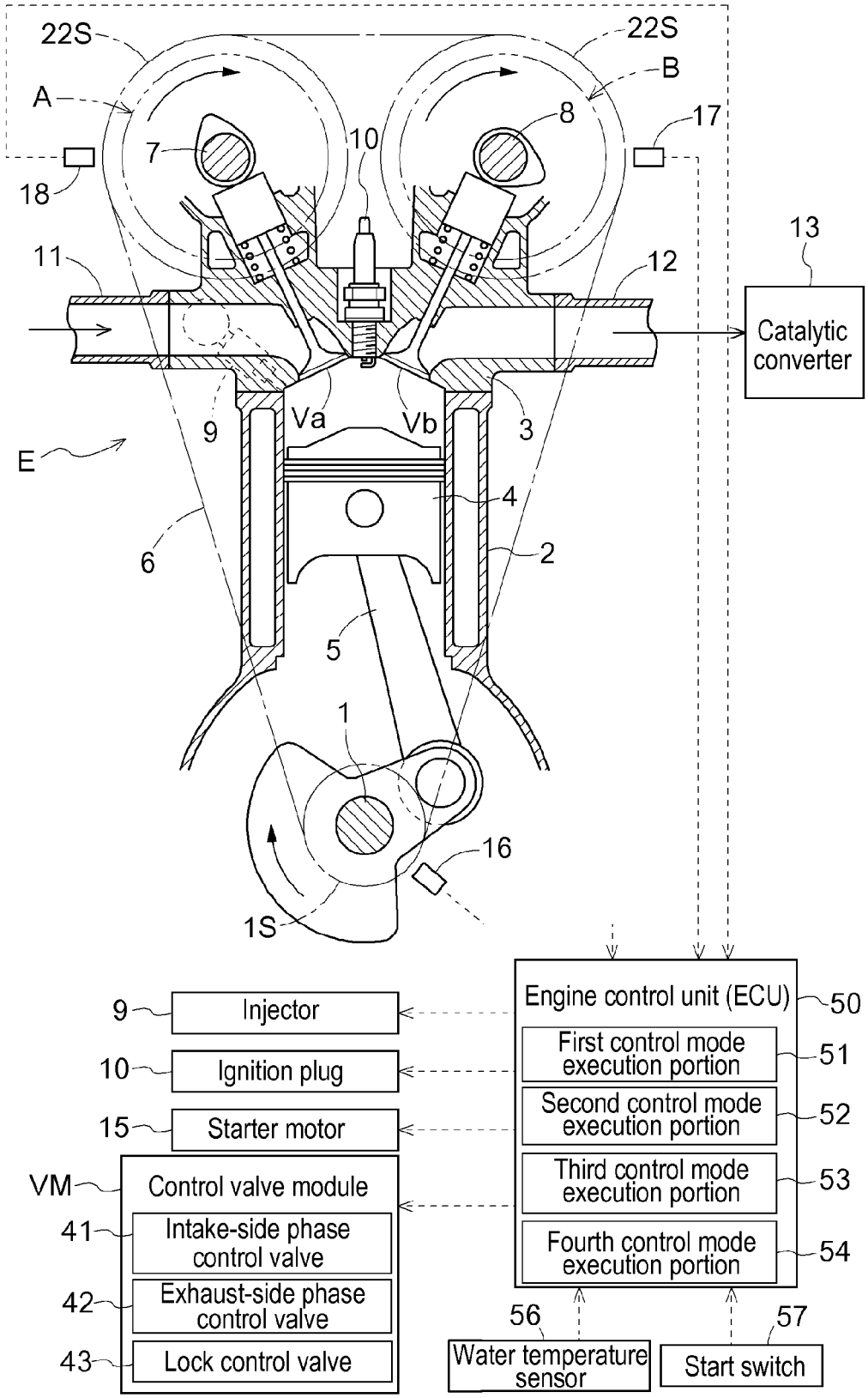
FIG. 1 is an overall view illustrating a configuration of a variable valve timing control unit according to an embodiment disclosed here.
Figure 2:
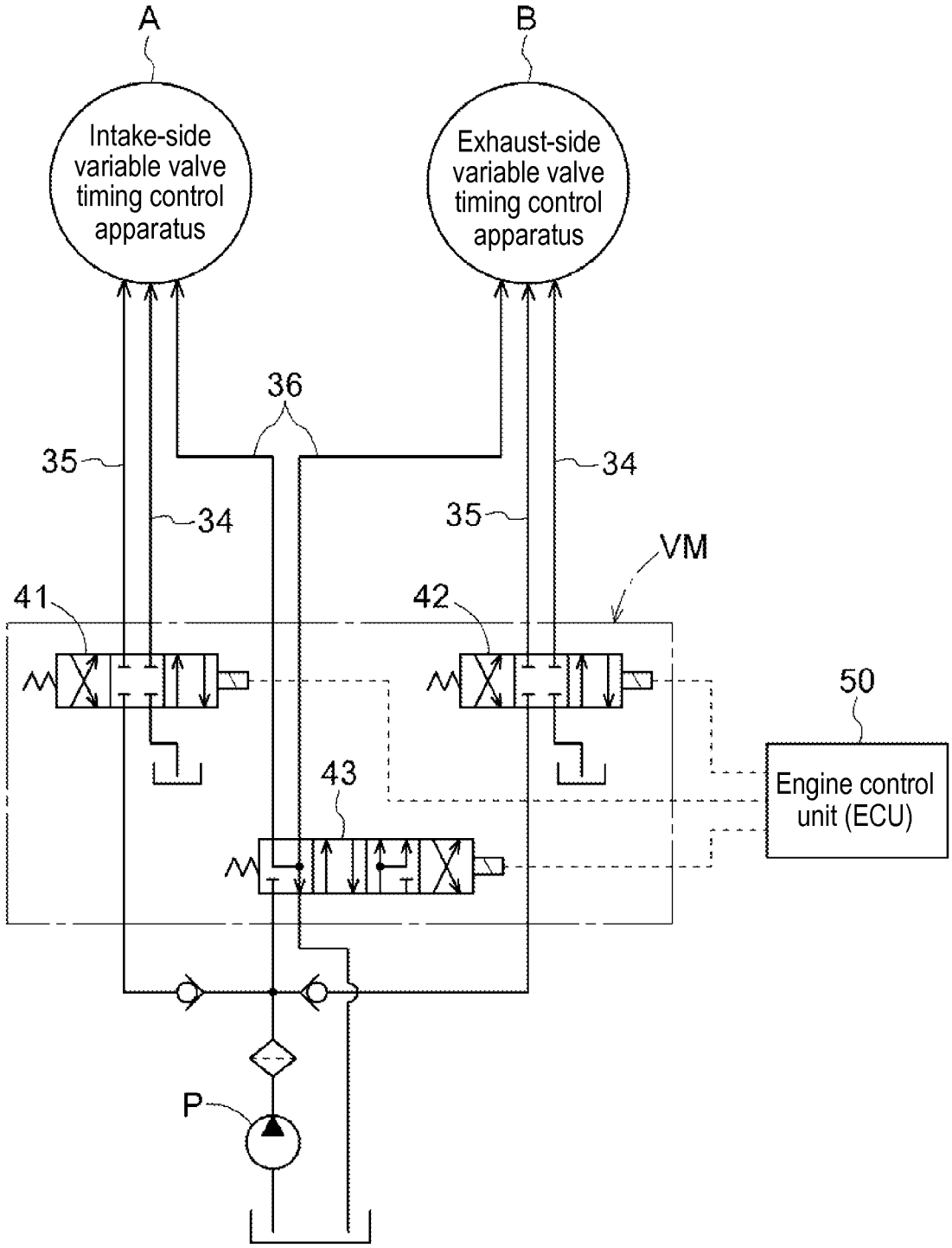
FIG. 2 is a view illustrating a fluid circuit of the variable valve timing control unit and a control valve module of the variable valve timing control unit.
Figure 3:
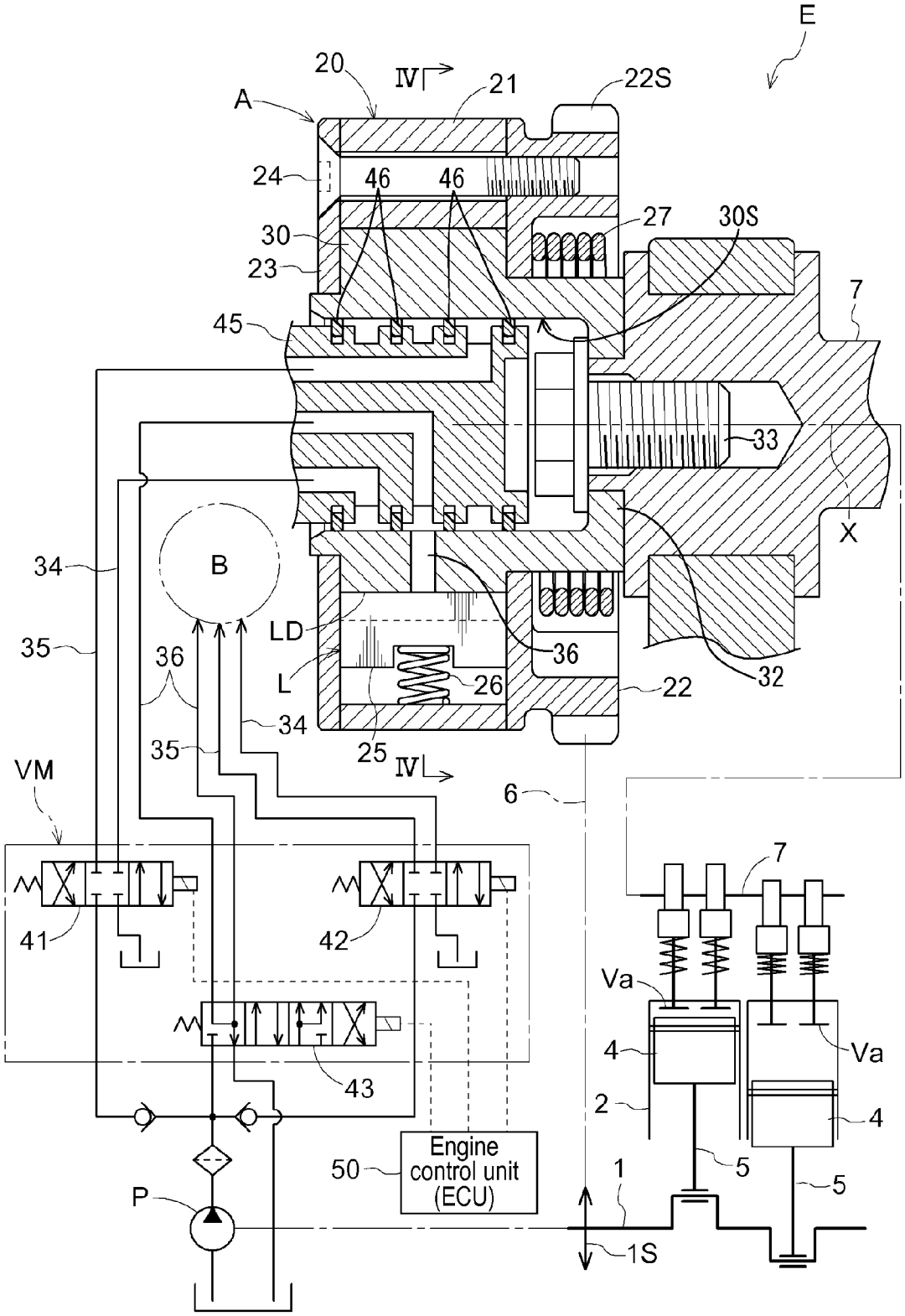
FIG. 3 is a view illustrating a cross-section of an intake-side variable valve timing control apparatus and the fluid circuit according to the embodiment.

An embodiment disclosed here will be explained with reference to the drawings. As illustrated in FIGS. 1 through 3 each of which illustrates a basic configuration of the embodiment, a variable valve timing control unit includes an intake-side variable valve timing control apparatus A, an exhaust-side variable valve timing control apparatus B, a control valve module VM and an engine control unit (ECU) 50. The intake-side variable valve timing control apparatus A controls an opening/closing timing of an intake valve Va of an engine E (i.e., an internal combustion engine). The exhaust-side variable valve timing control apparatus B controls an opening/closing timing of an exhaust valve Vb of the engine E.

At the variable valve timing control unit, the engine control unit (ECU) 50 performs a series of controls from start-up of the engine E (an example of the internal combustion engine) to stop of the engine E. At the control, the engine control unit (ECU) 50 controls the engine E and the control valve module VM, and thus a favorable or satisfactory start-up is realized. In addition, the opening/closing timings of the respective intake valve Va and exhaust valve Vb are appropriately controlled during operation of the engine E.

The engine E illustrated in FIG. 1 is mounted on a vehicle, including, a passenger vehicle. The engine E includes a crank shaft 1, a cylinder block 2 and a cylinder head 3. The cylinder head 3 is connected to an upper portion of the cylinder block 2 supporting the crank shaft 1. Plural cylinder bores are formed at the cylinder block 2 and a piston 4 is slidably accommodated in each of the cylinder bores. Each piston 4 is connected via a connecting rod 5 to the crank shaft 1.

The cylinder head 3 includes the intake valve Va which takes air into a combustion chamber and the exhaust valve Vb which exhausts or discharges combustion gas from the combustion chamber. The cylinder head 3 also includes an intake cam shaft 7 controlling the intake valve Va and an exhaust cam shaft 8 controlling the exhaust valve Vb. Accordingly, the engine E corresponds to a multi-cylinder four-cycle type engine.

In addition, the cylinder head 3 includes an injector 9 which sprays fuel into the combustion chamber, and an ignition plug 10. An intake manifold 11 which supplies air to the combustion chamber via the intake valve Va and an exhaust manifold 12 which sends out the exhaust gas from the combustion chamber via the exhaust valve Vb are connected to the cylinder head 3. A catalytic converter 13 which purifies the exhaust gas is arranged at a downstream-side relative to the exhaust manifold 12 in a direction of exhaustion.

For supplying oil in an oil pan as hydraulic fluid, a hydraulic pump P driven by a driving force of the crank shaft 1 is provided at the engine E. The hydraulic fluid from the hydraulic pump P is supplied to the control valve module VM, and then supplied from the control valve module VM to the intake-side variable valve timing control apparatus A and to the exhaust-side variable valve timing control apparatus B.

A drive sprocket 22S is formed at an outer periphery of an outer rotor 20 (an example of a driving-side rotation member) of each of the intake-side variable valve timing control apparatus A and the exhaust-side variable valve timing control apparatus B. A timing chain 6 is wound over the pair of drive sprockets 22S and an output sprocket 1S of the crank shaft 1. Due to the above-described configuration, a rotary force synchronized with rotations of the crank shaft 1 is transmitted to the intake-side variable valve timing control apparatus A and to the exhaust-side variable valve timing control apparatus B. At the engine E, a timing belt may be used instead of the timing chain 6. A gear train including plural gears may be used to transmit the driving force of the crank shaft 1 to the intake-side variable valve timing control apparatus A and to the exhaust-side variable valve timing control apparatus B.

The control valve module VM includes an intake-side phase control valve 41, an exhaust-side phase control valve 42 and a lock control valve 43, that is, a single lock control valve. The intake-side phase control valve 41 controls a phase of the intake-side variable valve timing control apparatus A and the exhaust-side phase control valve 42 controls a phase of the exhaust-side variable valve timing control apparatus B. The lock control valve 43 allows the lock members 25 of the respective intake-side variable valve timing control apparatus A and exhaust-side variable valve timing control apparatus B to engage (a locked state, that is, an engaged state is established) and to disengage. The lock control valve 43 will be explained in detail below.

The engine E includes a starter motor 15 transmitting a driving rotational force to the crank shaft 1, and a shaft sensor 16 arranged in a vicinity of the crank shaft 1 for detecting a rotational angle of the crank shaft 1 and a rotational speed of the crank shaft 1. An intake-side phase sensor 17 detecting a relative rotational phase of the outer rotor 20 and an inner rotor 30 relative to each other is provided in a vicinity of the intake-side variable valve timing control apparatus A. Similarly thereto, an exhaust-side phase sensor 18 detecting a relative rotational phase of the outer rotor 20 and the inner rotor 30 of the exhaust-side variable valve timing control apparatus B relative to each other is provided.

The engine E includes a water temperature sensor 56 detecting temperature of cooling water inside the cylinder block 2. In addition, the vehicle is provided with a start switch 57, and, for example, a driver may operate the start switch 57 to start up and stop the engine E. Because the water temperature sensor 56 is also for measuring temperature of the engine E, the water temperature sensor 56 may be arranged to be in contact with an outer surface of the engine E for measuring temperature of an outer wall of the engine E.

The engine control unit 50 includes a first control mode execution portion 51, a second control mode execution portion 52, a third control mode execution portion 53 and a fourth control mode execution portion 54 each of which is configured by software. In addition, signals from the shaft sensor 16, the intake-side phase sensor 17, the exhaust-side phase sensor 18, the water temperature sensor 56 and the start switch 57 are inputted to the engine control unit 50.

The engine control unit 50 outputs control signals to a control portion of the injector 9, a control portion of the ignition plug 10 and a control portion of the starter motor 15. The engine control unit 50 outputs control signals also to the intake-side phase control valve 41, the exhaust-side phase control valve 42 and the lock control valve 43 of the control valve module VM. A form of the control of the engine control unit 50 will be described below.

The intake-side variable valve timing control apparatus A and the exhaust-side variable valve timing control apparatus B include a common configuration therebetween. The common configuration will be described hereunder with reference to FIGS. 3 to 5.

FIG. 3 illustrates the intake-side variable valve timing control apparatus A and a fluid circuit connected to the intake-side variable valve timing control apparatus A. The intake-side variable valve timing control apparatus A includes the outer rotor 20 rotating synchronously with the crank shaft 1 and serving as the driving-side rotation member, and the inner rotor 30 serving as a driven-side rotation member. Each of the outer rotor 20 and the inner rotor 30 is arranged to be coaxially with a rotational axis X of the intake cam shaft 7. The outer rotor 20 and the inner rotor 30 are supported to be rotatable about the rotational axis X relative to each other in a state that the inner rotor 30 is included within the outer rotor 20. In a similar manner to the intake-side variable valve timing control apparatus A, at the exhaust-side variable valve timing control apparatus B, the outer rotor 20 and the inner rotor 30 are arranged to be coaxially with a rotational axis X of the exhaust cam shaft 8. The outer rotor 20 and the inner rotor 30 are supported to be rotatable about the rotational axis X relative to each other in the state that the inner rotor 30 is included within the outer rotor 20.

The inner rotor 30 (an example of the driven-side rotation member) of the intake-side variable valve timing control apparatus A is connected to the intake cam shaft 7 with a connecting bolt 33. By setting the relative rotational phase of the outer rotor 20 and the inner rotor 30 relative to each other (which will be hereinafter referred to as the relative rotational phase), an opening/closing timing of the intake valve Va is changed or varied. In a similar manner thereto, the inner rotor 30 of the exhaust-side variable valve timing control apparatus B is connected to the exhaust cam shaft 8 with a connecting bolt 33. By setting the relative rotational phase of the outer rotor 20 and the inner rotor 30, an opening/closing timing of the exhaust valve Vb is changed or varied.

The outer rotor 20 includes a rotor main body 21 formed in a cylindrical shape, a rear block 22 and a front plate 23. The rear block 22 is arranged at one end portion of the rotor main body 21 in a direction along the rotational axis X and the front plate 23 is arranged at the other end portion of the rotor main body 21 in the direction along the rotational axis X. The rotor main body 21, the rear block 22 and the front plate 23 are fastened to one another with plural fastening bolts 24.

The drive sprocket 22S is formed at the outer periphery of the outer rotor 20. The rotor main body 21 includes an inner wall surface formed in a cylindrical shape and plural protruding portions 21T. Each of the protruding portions 21T is formed integrally with the rotor main body 21 so as to protrude towards the rotational axis X (an inner side in a radial direction of the outer rotor 20). As described above, the timing chain 6 is wound around or attached to the drive sprocket 22S so that the rotary force is transmitted from the crank shaft 1.

A guide groove is formed at each of the two protruding portions 21T, from among the plural protruding portions 21T, the two which are arranged to oppose each other with respect to the rotational axis X. Each of the guide grooves is formed in a posture extending radially from the rotational axis X, that is, the guide grove is formed to be extended radially from the rotational axis X. A lock member 25 formed in a plate shape is placed by insertion in each of the guide grooves in such a manner that the lock member 25 may come out of the groove and be inserted therein. A lock spring 26 serving as a biasing member is provided inside the rotor main body 21 for biasing the corresponding lock member 25 towards the rotational axis X.

Figure 4:
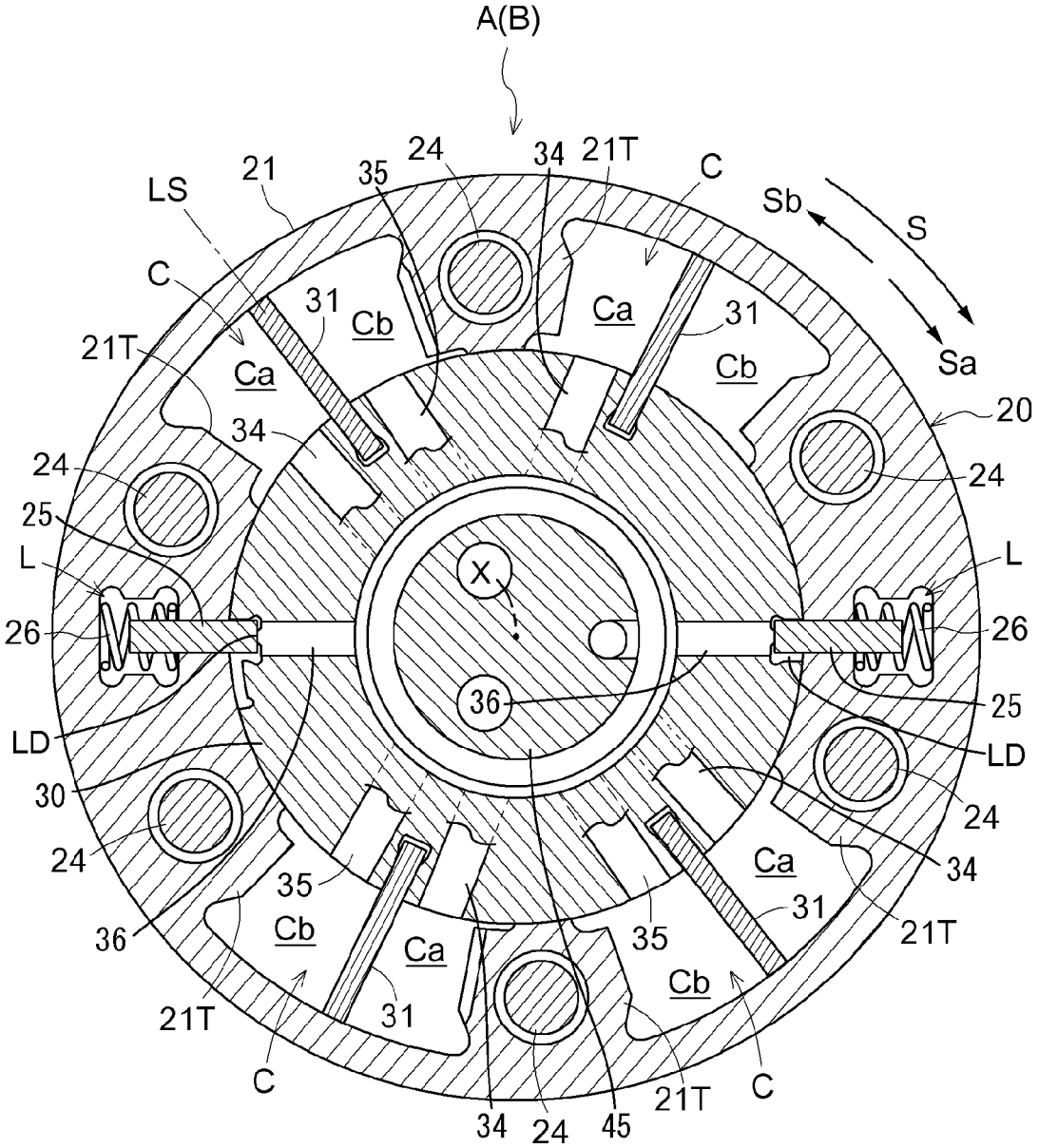
FIG. 4 is a cross-sectional view taken along line IV-IV in FIG. 3, which illustrates the intake-side variable valve timing control apparatus.
Figure 5:
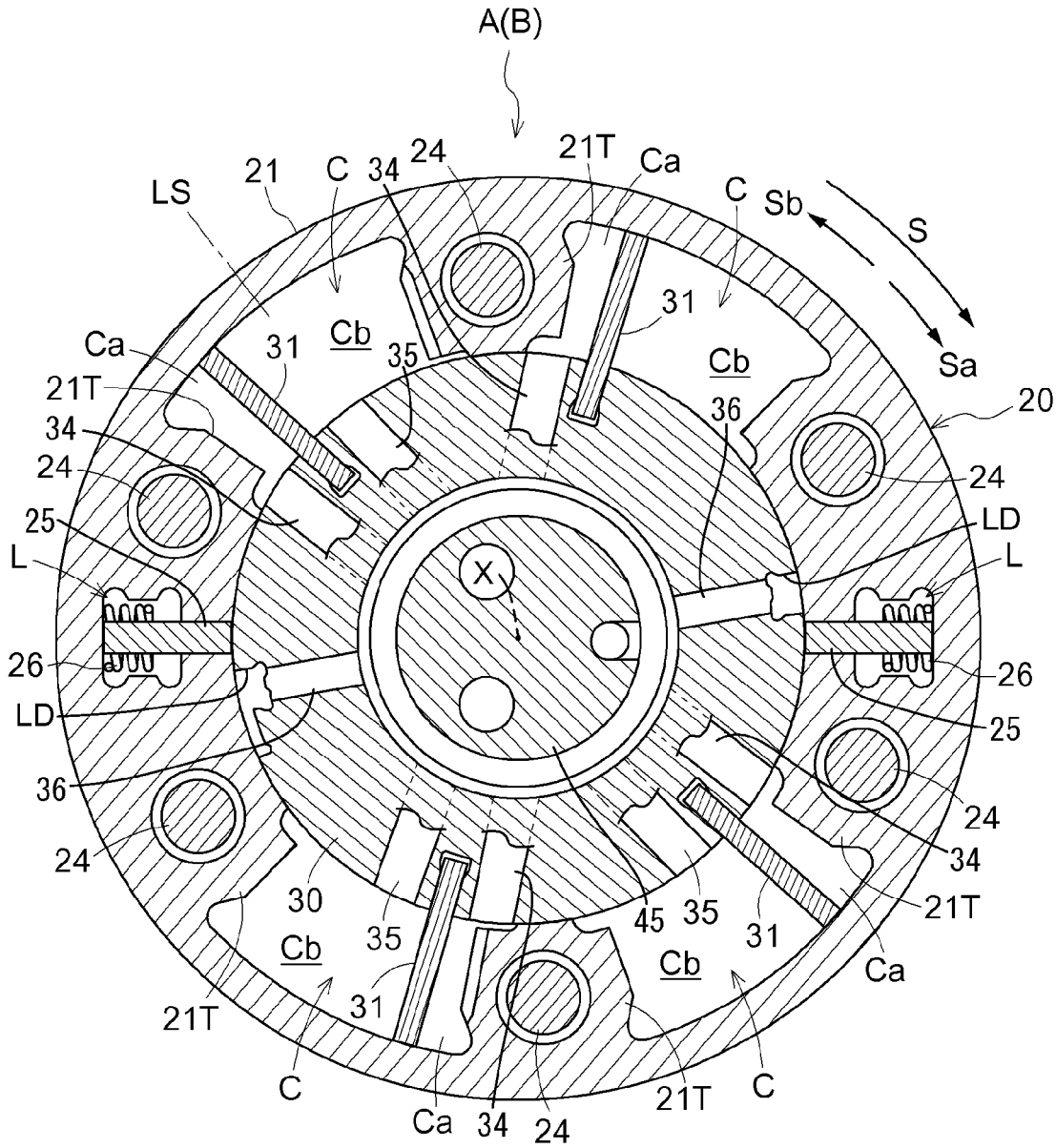
FIG. 5 is a cross-sectional view illustrating the intake-side variable valve timing control apparatus in an unlocked state.
Figure 6:
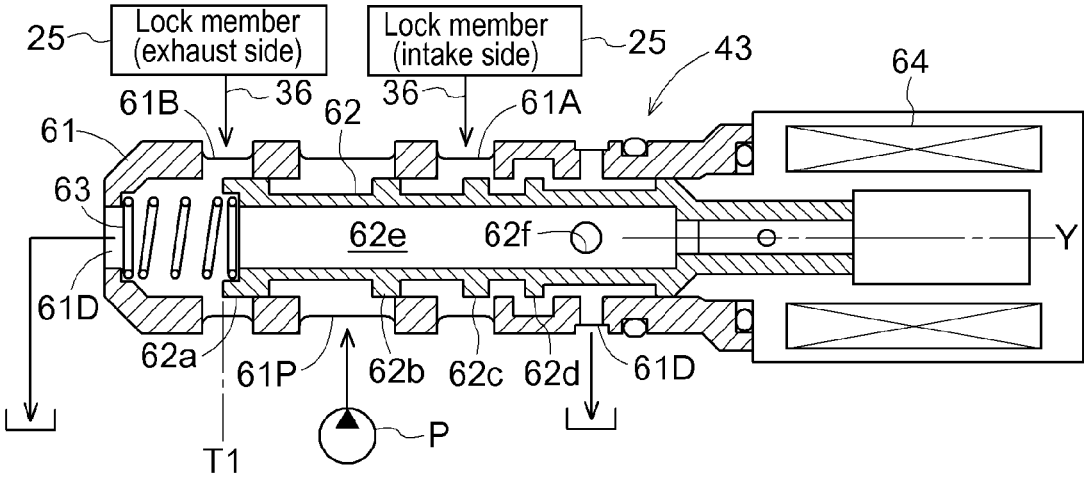
FIG. 6 is a cross-sectional view of a lock control valve in a state where a spool of the lock control valve is at a first control position according to the embodiment.

When the relative rotational phase of the outer rotor 20 and the inner rotor 30 is in a lock phase LS illustrated in FIG. 4, the two lock members 25 are inserted in respective lock recessed portions LD by biasing forces of the respective lock springs 26, and accordingly the intake-side variable valve timing control apparatus A keeps the relative rotational phase in the lock phase LS. Thus, the outer rotor 20 and the inner rotor 30 are in an integral rotation state. The lock phase LS is set at a substantially intermediate phase position between a most advanced angle and a most retarded angle. The exhaust-side variable valve timing control apparatus B includes a configuration similar to the intake-side variable valve timing control apparatus A, and accordingly, when the relative rotational phase of the outer rotor 20 and the inner rotor 30 is in the lock phase LS illustrated in FIG. 4, the exhaust-side variable valve timing control apparatus B keeps the relative rotational phase in the lock phase LS, in a manner that the two lock members 25 are inserted in respective lock recessed portions LD by biasing forces of the respective lock springs 26.

The lock member 25, the lock spring 26 and the lock recessed portion LD form a lock mechanism L. The shape of each of the lock members 25 is not limited to the plate shape and the lock member 25 may be formed in a rod shape, for example. In addition, the lock phase LS is not limited to the phase illustrated in FIG. 4, and the lock phase LS may be set to be closer to an advanced angle side or closer to a retarded angle side than the lock phase LS illustrated in FIG. 4.

A torsion spring 27 is arranged over the rear block 22 of the outer rotor 20 and the inner rotor 30. The torsion spring 27 is configured to apply a biasing force at least until the relative rotational phase reaches the intermediate phase even in a state where the relative rotational phase is at the most retarded angle, for example.

At the intake-side variable valve timing control apparatus A and the exhaust-side variable valve timing control apparatus B, each of the outer rotors 20 is rotated in a driving rotational direction S by the driving force transmitted from the timing chain 6. A direction in which the inner rotor 30 rotates relative to the outer rotor 20 in the same direction as the driving rotational direction S is referred to as an advanced angle direction Sa. A direction opposite to the advanced angle direction Sa is referred to as a retarded angle direction Sb.

By displacing the relative rotational phase in the advanced angle direction Sa, the intake-side variable valve timing control apparatus A advances a releasing time (a releasing timing) of the intake valve Va and a closing time (a closing timing) of the intake valve Va. To the contrary, by displacing the relative rotational phase in the retarded angle direction Sb, the intake-side variable valve timing control apparatus A delays the releasing time (the releasing timing) of the intake valve Va and the closing time (the closing timing) of the intake valve Va. By displacing the relative rotational phase in the advanced angle direction Sa, the exhaust-side variable valve timing control apparatus B advances a releasing time (a releasing timing) of the exhaust valve Vb and a closing time (a closing timing) of the exhaust valve Vb. To the contrary, by displacing the relative rotational phase in the retarded angle direction Sb, the exhaust-side variable valve timing control apparatus B delays the releasing time (the releasing timing) of the exhaust valve Vb and the closing time (the closing timing) of the exhaust valve Vb.

The inner rotor 30 includes an inner circumferential surface 30S which is formed in a shape of a cylinder inner surface that is coaxial with the rotation axis X, and an outer circumferential surface which is formed in a cylindrical shape that is coaxial with the rotation axis X. Plural vanes 31 are fitted in the outer circumferential surface of the inner rotor 30 so as to protrude outwardly. Each of the vanes 31 is biased by a spring, for example, in a direction away from the rotational axis X.

Because the inner rotor 30 is fitted in (included in) the outer rotor 20, a fluid pressure chamber C is formed between an inner side surface (that is, the inner wall surface formed in the cylindrical shape and the plural protruding portions 21T) of the rotor main body 21 and the outer circumferential surface of the inner rotor 30. A protruding distal end of each of the vanes 31 is in contact with an inner circumferential surface of the outer rotor 20, which forms the fluid pressure chamber C, and thus the vane 31 partitions or divides the fluid pressure chamber C into an advanced angle chamber Ca and a retarded angle chamber Cb.

A collar-shaped portion 32 is provided at one end portion of the inner rotor 30 in the direction along the rotational axis X. The connection bolt 33 is inserted through a hole portion formed at an inner circumferential position of the collar-shaped portion 32, and accordingly the inner rotor 30 is connected to the intake cam shaft 7 or to the exhaust cam shaft 8.

Each of the inner rotors 30 of the intake-side variable valve timing control apparatus A and the exhaust-side variable valve timing control apparatus B includes an advanced angle fluid passage 34 which is in fluid communication with the advanced angle chamber Ca, a retarded angle fluid passage 35 which is in fluid communication with the retarded angle chamber Cb, and an unlock fluid passage 36 which supplies the hydraulic fluid to the lock recessed portion LD in an unlocking direction.

Due to the above-described configuration, each of the intake-side variable valve timing control apparatus A and the exhaust-side variable valve timing control apparatus B displaces the relative rotational phase in the advanced angle direction Sa in a case where the hydraulic fluid (an example of the fluid) is supplied to the advanced angle chamber Ca via the advanced angle fluid passage 34. In a similar manner thereto, the hydraulic fluid is supplied via the retarded angle fluid passage 35 to the retarded angle chamber Cb, and accordingly the relative rotational phase is displaced in the retarded angle direction Sb.

The relative rotational phase when the vane 31 reaches a movable end (a limit of the rotation about the axis X) in the advanced angle direction Sa is referred to as a most advanced angle phase, and the relative rotational phase when the vane 31 reaches a movable end (a limit of the rotation about the axis X) to a retarded angle-side is referred to as a most retarded angle phase.

The control valve module VM will be described hereunder. Each of the intake-side phase control valve 41 and the exhaust-side phase control valve 42 is a solenoid-operated type valve and is operable to be positioned at three positions. The lock control valve 43 is a solenoid-operated type valve and is operable to be positioned at four positions.

As illustrated in FIG. 3, a fluid passage forming shaft portion 45 formed in a circular column is inserted in the inner circumferential surface 30S of the inner rotor 30 of the exhaust-side variable valve timing control apparatus B. The exhaust-side phase control valve 42 is provided at a unit case which is formed integrally with the fluid passage forming shaft portion 45. In a similar manner thereto, a fluid passage forming shaft portion 45 is inserted in the inner circumferential surface 30S of the inner rotor 30 of the intake-side variable valve timing control apparatus A, and the intake-side phase control valve 41 is provided at a unit case which is formed integrally with the fluid passage forming shaft portion 45.

In the present embodiment, the lock control valve 43 is assumed to be provided at the unit case of the intake-side variable valve timing control apparatus A or at the unit case of the exhaust-side variable valve timing control apparatus B, however, the lock control valve 43 may be configured not to be provided at either unit case.

The control valve module VM may be configured in such a manner that each of the intake-side phase control valve 41, the exhaust-side phase control valve 42 and the lock control valve 43 is positioned to be separated from the intake-side variable valve timing control apparatus A and from the exhaust-side variable valve timing control apparatus B.

At an outer circumferential surface of each of the fluid passage forming shaft portions 45 of the respective intake-side variable valve timing control apparatus A and exhaust-side variable valve timing control apparatus B, a groove-shaped portion which is formed in an annular shape and is in fluid communication with a port of the intake-side phase control valve 41. Another groove-shaped portion which is formed in an annular shape and is in fluid communication with a corresponding port of the lock control valve 43 from among ports of the lock control valve 43 is provided at the outer circumferential surface of each of the fluid passage forming shaft portions 45 of the respective intake-side variable valve timing control apparatus A and exhaust-side variable valve timing control apparatus B. Plural seals 46 each formed in a ring shape are provided between the outer circumferential surface of the fluid passage forming shaft portions 45 and the inner circumferential surface 30S of the inner rotor 30 so that the groove-shaped portions are separated from one another by the seals 46.

Each of the intake-side phase control valve 41 and the exhaust-side phase control valve 42 selects one of the advanced angle fluid passage 34 and the retarded angle fluid passage 35, and supplies the hydraulic fluid to the selected one of the advanced angle fluid passage 34 and the retarded angle fluid passage 35, while each of the intake-side phase control valve 41 and the exhaust-side phase control valve 42 discharges or drains the hydraulic fluid from the other of the advanced angle fluid passage 34 and the retarded angle fluid passage 35. Accordingly, the intake-side phase control valve 41 and the exhaust-side phase control valve 42 operate so as to displace the relative rotational phase of the apparatus in the advanced angle direction Sa or in the retarded angle direction Sb.

The lock control valve 43 of the control valve module VM will be described hereunder. The lock control valve 43 keeps and releases the locked states of the respective lock mechanisms L of the intake-side variable valve timing control apparatus A and the exhaust-side variable valve timing control apparatus B. That is, in a case where the lock control valve 43 keeps the locked state, the lock control valve 43 discharges the hydraulic fluid from the unlock fluid passage 36 thereby to establish a state where the lock member 25 is inserted by the biasing force of the lock spring 26 into the lock recessed portion LD. To the contrary, in a case where the lock control valve 43 releases the locked state, the lock control valve 43 supplies the hydraulic fluid into the unlock fluid passage 36 thereby to cause the lock member 25 to move in a direction in which the lock member 25 comes out of the lock recessed portion LD against the biasing force of the lock spring 26.

As illustrated in FIGS. 6 to 9, the lock control valve 43 includes a valve case 61 formed in a cylindrical shape or a tubular shape, a spool 62 fitted in the valve case 61 to be movable along a spool axis Y relative to the valve case 61, a spool spring 63 biasing the spool 62, and an electromagnetic solenoid 64 which causes the spool 62 to apply an actuating force.

The valve case 61 includes a pump port 61P, a drain port 61D, an intake-side lock control port 61A and an exhaust-side lock control port 61B. The hydraulic fluid is supplied from the hydraulic pump P to the pump port 61P and is discharged from the drain port 61D. The intake-side lock control port 61A is in fluid communication with the unlock fluid passage 36 of the intake-side variable valve timing control apparatus A. The exhaust-side lock control port 61B is in fluid communication with the unlock fluid passage 36 of the exhaust-side variable valve timing control apparatus B.

The spool 62 is formed in a cylindrical shape, and includes a first land portion 62*a*, a second land portion 62*b*, a third land portion 62*c* and a fourth land portion 62*d* which are formed to be arranged in the mentioned order along the spool axis Y at an outer circumferential surface of the spool 62. A fluid drain space portion 62*e* is provided inside the spool 62 for discharging or draining the hydraulic fluid and a communication hole 62*f* is provided at an outer wall portion of the spool 62 for sending the hydraulic fluid from the fluid drain space portion 62*e* to the drain port 61D.

At the lock control valve 43, the spool 62 is kept at a first control position T1 by a biasing force of the spool spring 63 when the electromagnetic solenoid 64 is not electrified or not energized. As electric power supplied to the electromagnetic solenoid 64 increases, the spool 62 is moved in the direction along the spool axis Y against the biasing force of the spool spring 63 so that the spool 62 is brought to be sequentially set or positioned at a second control position T2, a third control position T3 and a fourth control position T4 in this order.

The first control position T1 is an example of the first control state. Similarly thereto, the second control position T2 is an example of the second control state, the third control position T3 is an example of the third control state, and the fourth control position T4 is an example of the fourth control state.

The first control position will be described hereunder. In a case where the spool 62 of the lock control valve 43 is set at the first control position T1 illustrated in FIG. 6, the first land portion 62*a* blocks a flow of the hydraulic fluid from the pump port 61P to the exhaust-side lock control port 61B. Similarly, the second land portion 62*b* blocks a flow of the hydraulic fluid from the pump port 61P to the intake-side lock control port 61A. In addition, at the first control position T1, the intake-side lock control port 61A is in fluid communication with the drain port 61D via an outer periphery-side of the spool 62, and the exhaust-side lock control port 61B is in fluid communication with the drain port 61D via the oil drain space portion 62*e* and communication hole 62*f* of the spool 62.

Accordingly, pressure of the hydraulic fluid is not applied to the lock members 25 of the respective intake-side variable valve timing control apparatus A and exhaust-side variable valve timing control apparatus B. As a result, each of the lock mechanisms L is kept in the locked state.

Figure 7:
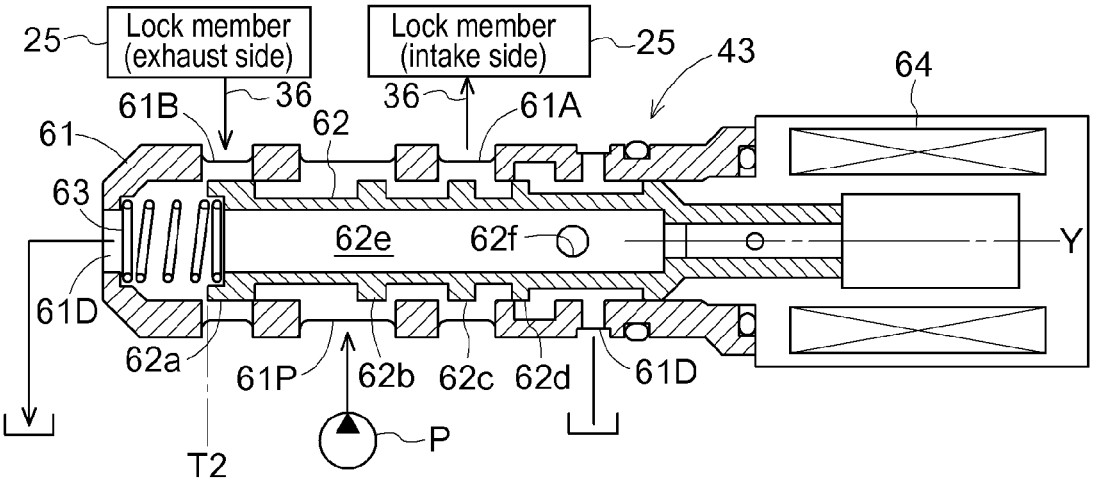
FIG. 7 is a cross-sectional view of the lock control valve in a state where the spool is at a second control position.

Next, the second control position will be described hereunder. In a case where the spool 62 is set at the second control position T2 as illustrated in FIG. 7, the first land portion 62*a* blocks the flow of the hydraulic fluid from the pump port 61P to the exhaust-side lock control port 61B while the exhaust-side lock control port 61B remains in fluid communication with the drain port 61D. At the same time, the pump port 61P comes to be in fluid communication with the intake-side lock control port 61A via the outer periphery-side of the spool 62 and the fourth land portion 62*d* blocks a flow of the hydraulic fluid from the intake-side lock control port 61A to a drain-side.

Accordingly, the lock mechanism L of the exhaust-side variable valve timing control apparatus B is kept in the locked state. The pressure of the hydraulic fluid is applied to the lock member 25 of the lock mechanism L of the intake-side variable valve timing control apparatus A, and thus the locked state of the lock mechanism L of the intake-side variable valve timing control apparatus A is released or unlocked.

Figure 8:
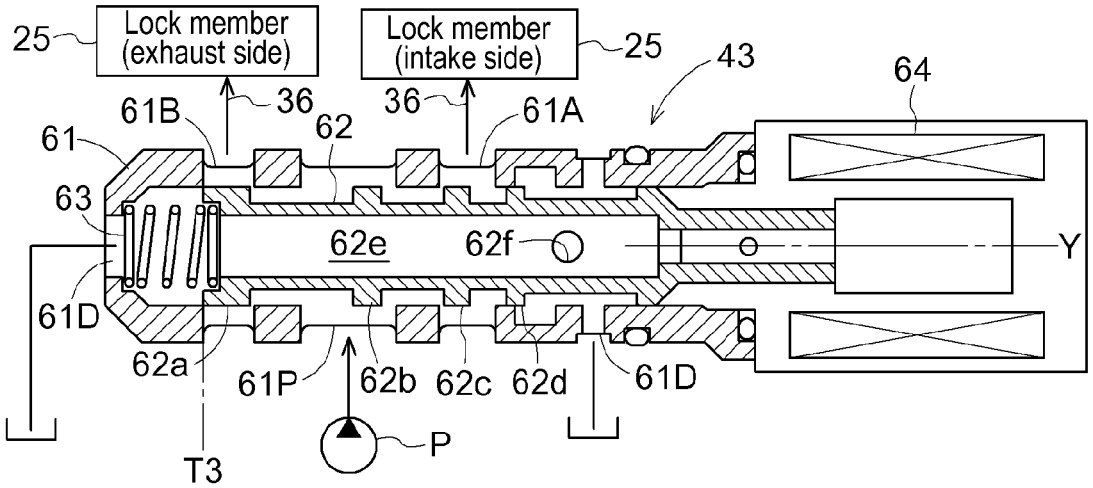
FIG. 8 is a cross-sectional view of the lock control valve in a state where the spool is at a third control position.

Next, the third control position will be described hereunder. In a case where the spool 62 is set at the third control position T3 as illustrated in FIG. 8, the first land portion 62*a* blocks the fluid communication between the exhaust-side lock control port 61B and the drain port 61D. The pump port 61P is in fluid communication with the exhaust-side lock control port 61B via an outer periphery-side of the first land portion 62*a*, and thus the flow of the hydraulic fluid is allowed.

In a similar manner to the second control position T2, the pump port 61P and the intake-side lock control port 61A remain in fluid communication with each other while the fourth land portion 62*d* blocks the flow of the hydraulic fluid from the intake-side lock control port 61A to the drain port 61D.

Accordingly, the pressure of the hydraulic fluid is applied to the lock members 25 of the lock mechanisms L of the respective intake-side variable valve timing control apparatus A and exhaust-side variable valve timing control apparatus B, and thus the locked state of each of the lock mechanisms L is released.

Figure 9:
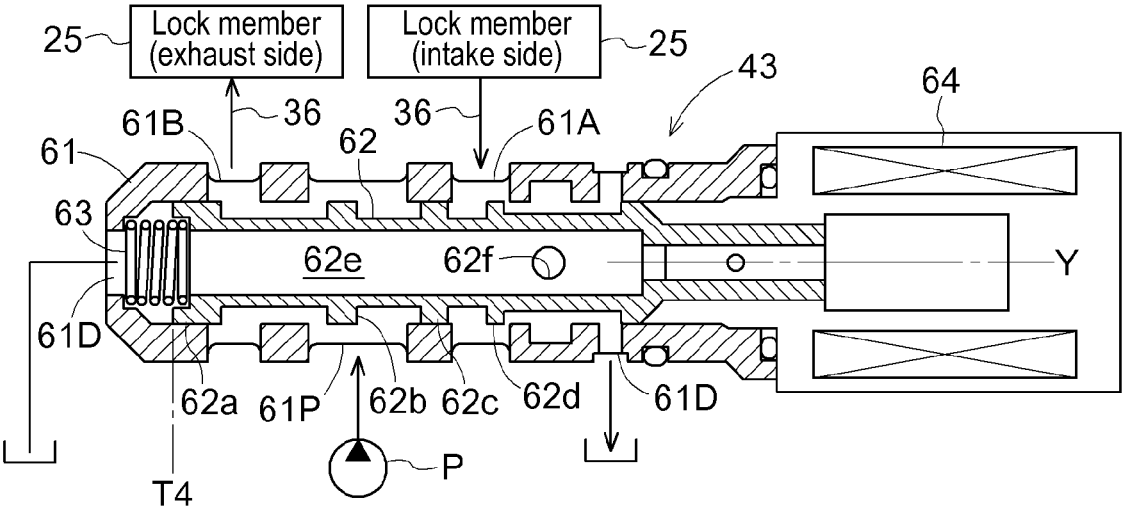
FIG. 9 is a cross-sectional view of the lock control valve in a state where the spool is at a fourth control position.

Next, the fourth control position will be described hereunder. In a case where the spool 62 is set at the fourth control position T4 as illustrated in FIG. 9, in a similar manner to the third control position, the first land portion 62*a* blocks the fluid communication between the exhaust-side lock control port 61B and the drain port 61D, and the pump port 61P is in fluid communication with the exhaust-side lock control port 61B via the outer periphery-side of the first land portion 62*a*.

In addition, the third land portion 62*c* blocks a flow of the hydraulic fluid from the pump port 61P to the intake-side lock control port 61A, and the intake-side lock control port 61A is in fluid communication with the drain port 61D via the outer periphery-side of the spool 62.

Accordingly, the pressure of the hydraulic fluid is applied to the lock member 25 of the lock mechanism L of the exhaust-side variable valve timing control apparatus B, and thus the locked state of the lock mechanism L is released. The lock mechanism L of the intake-side variable valve timing control apparatus A is in the locked state.

The engine control unit 50 will be described hereunder. As illustrated in FIG. 1, the engine control unit 50 is configured as an ECU by using, for example, a microprocessor and a digital signal processor (DSP) and implements or executes the controls with the software. The first control mode execution portion 51, the second control mode execution portion 52, the third control mode execution portion 53 and the fourth control mode execution portion 54 are configured by the software. The first control mode execution portion 51, the second control mode execution portion 52, the third control mode execution portion 53 and the fourth control mode execution portion 54 may be configured by hardware or a combination of the software and the hardware.

The first control mode execution portion 51 maintains the locked states of the respective lock mechanisms L of the intake-side variable valve timing control apparatus A and the exhaust-side variable valve timing control apparatus B, and controls the start-up of the engine E. After the start-up of the engine E, the second control mode execution portion 52 maintains the locked state of the lock mechanism L of the exhaust-side variable valve timing control apparatus B while the second control mode execution portion 52 releases the locked state of the lock mechanism L of the intake-side variable valve timing control apparatus A to conduct the warm-up of the engine E.

After completion of the warm-up of the engine E, the third control mode execution portion 53 releases the locked states of the respective lock mechanisms L of the intake-side variable valve timing control apparatus A and the exhaust-side variable valve timing control apparatus B, and controls the opening/closing timings of the respective intake valve Va and exhaust valve Vb optimally so that the engine E operates. The fourth control mode execution portion 54, after completion of the warm-up of the engine E, sets the lock mechanism L of the intake-side variable valve timing control apparatus A in the locked state and releases the locked state of the lock mechanism L of the exhaust-side variable valve timing control apparatus B.

Figure 10:
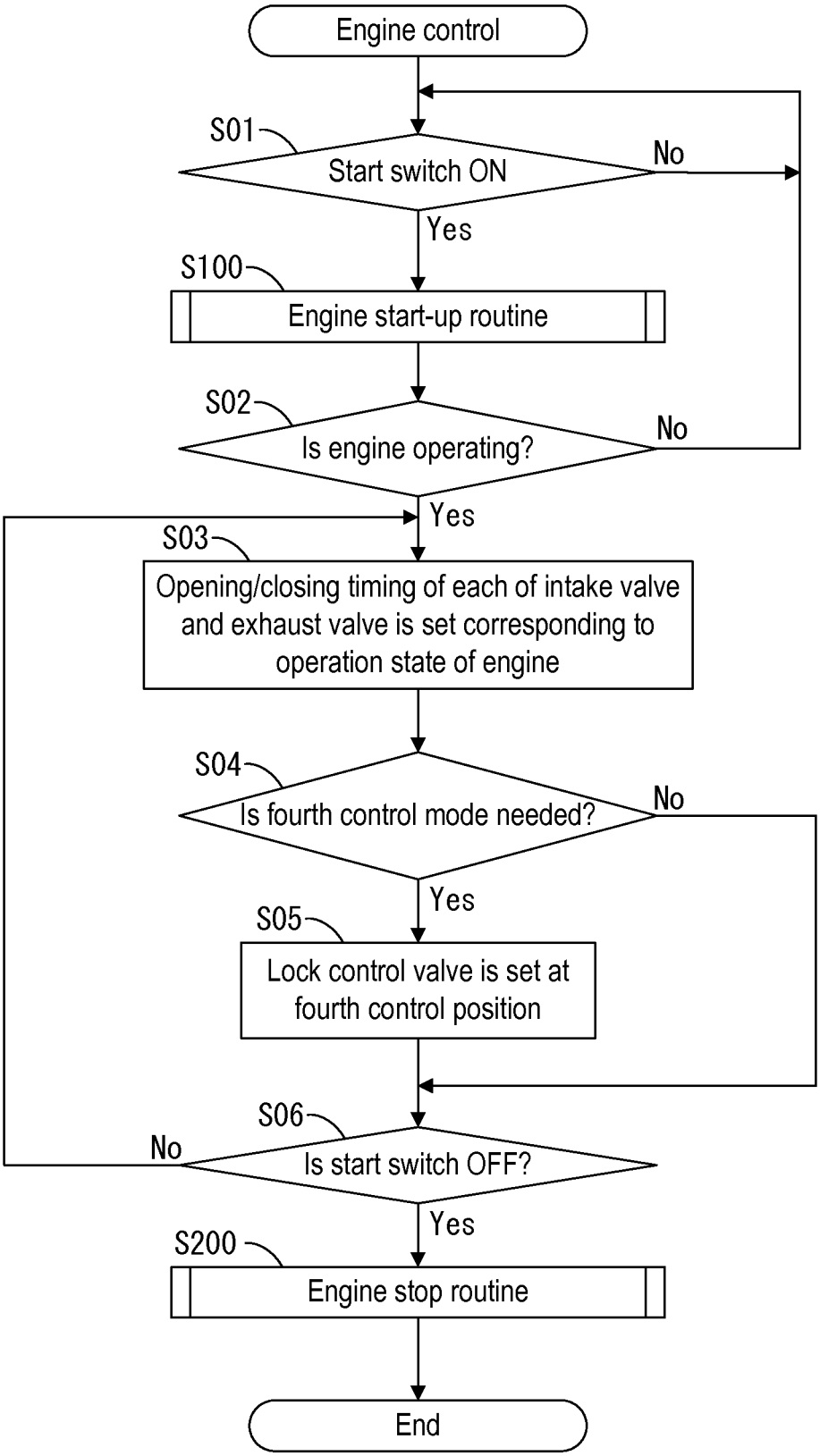
FIG. 10 is a flowchart of an engine control according to the embodiment.

An engine control will be described hereunder. The form of the control performed by the engine control unit 50 is indicated in the flowchart in FIG. 10. In an initial state of the engine control, it is assumed that each of the lock mechanisms L of the respective intake-side variable valve timing control apparatus A and exhaust-side variable valve timing control apparatus B is in the locked state and that the engine E is stopped. In this state, in a case where the start switch 57 is turned on (Step S01), processing of an engine start-up routine is executed (Steps S02 and S100). After that, in a state where the engine operates, each of the opening/closing timings of the intake valve Va and the exhaust valve Vb is set corresponding to an operation state of the engine E. Only in a case where the fourth control mode needs to be executed, the lock control valve 43 is set at the fourth control position T4 (Steps S03 to S05). Then, in a case where the start switch 57 is turned off, an engine stop routine is executed (Steps S06 and S200).

During the above-described controls, when setting the lock control valve 43 at the fourth control position T4, the lock control valve 43 is already set at the third control position T3 as will be described below in an explanation about the engine start-up routine. Accordingly, an operation of changing the control position of the lock control valve 43 to the fourth control position T4 is performed quickly.

Figure 11:
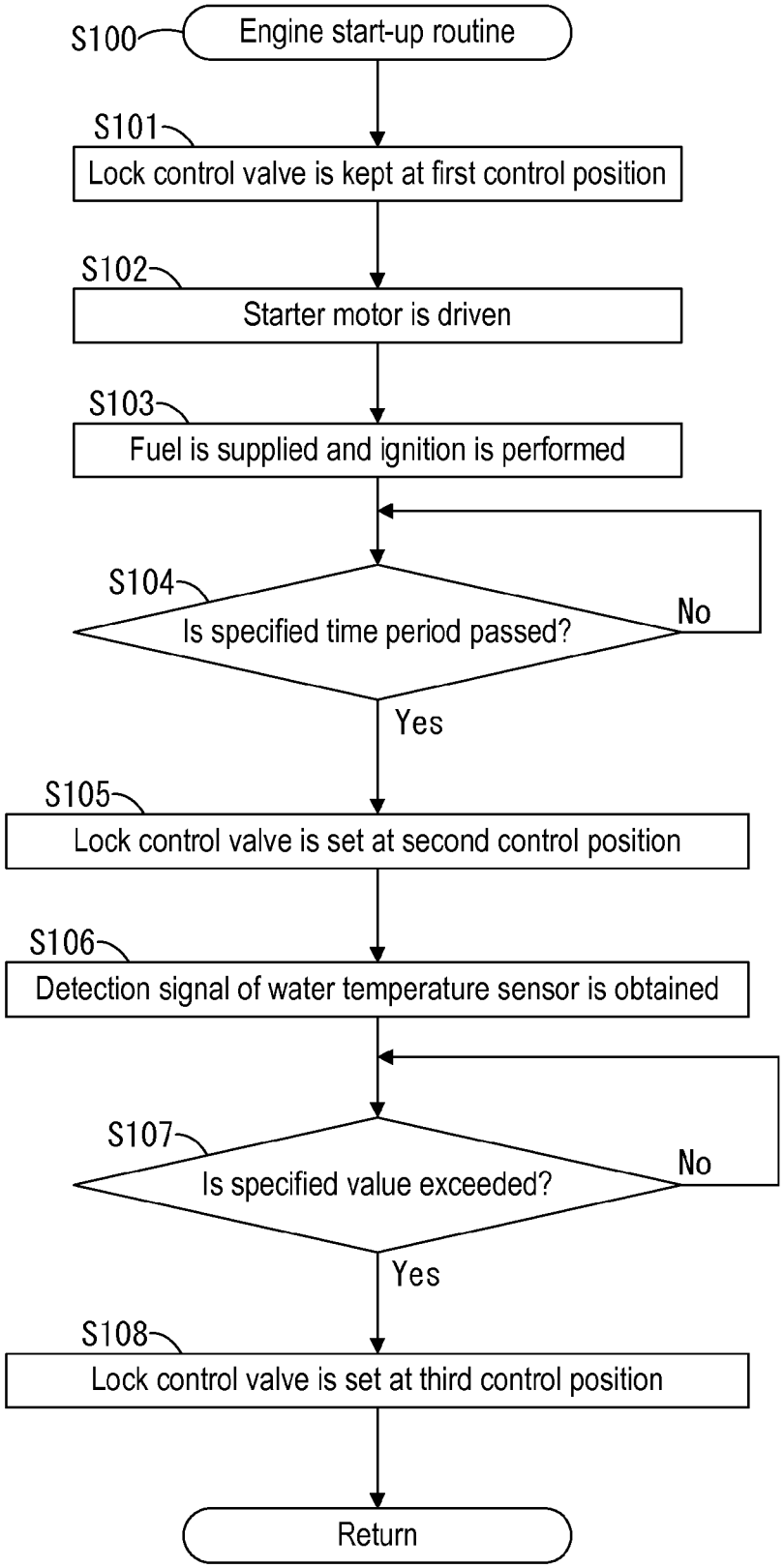
FIG. 11 is a flowchart of an engine start-up routine according to the embodiment.

The engine start-up routine (Step S100) will be described hereunder. As illustrated in the flowchart in FIG. 11, in a state where the lock control valve 43 is kept at the first control position T1, the starter motor 15 is driven to start cranking. In association with this, the fuel is supplied to the combustion chamber via the injector 9, and the ignition is performed by the ignition plug 10 (Steps S101 to S103).

In the first control mode described above, in a state where the electric power is not supplied to the electromagnetic solenoid 64 as described above, the lock control valve 43 maintains the first control position T1. Thus, the electric power is not supplied to the electromagnetic solenoid 64 at the start-up of the engine E.

In the engine start-up routine, it is assumed that the lock mechanisms L of the respective intake-side variable valve timing control apparatus A and exhaust-side variable valve timing control apparatus B are in the locked states. Accordingly, by keeping the locked states, the cranking is performed in a state where the relative rotational phases are maintained in phases that are appropriate for the start-up.

At the start-up of the engine E, a supply amount of the hydraulic fluid supplied from the hydraulic pump P is insufficient and the pressure is low. Accordingly, for example, in a case where the lock mechanism L is not in the locked state, each of the outer rotor 20 and the inner rotor 30 may be displaced in the advanced angle direction Sa and the retarded angle direction Sb alternately in such a manner that the outer rotor 20 and the inner rotor 30 oscillate. However, the lock mechanism L prevents such an inconvenient event from occurring.

When the engine E starts up under the engine start-up routine and after a specified time period passed, the lock control valve 43 is set at the second control position T2 and the control mode is moved to the second control mode by the control of the intake-side phase control valve 41 (Steps S104, and S105).

The specified time period is specified at approximately several seconds. Thus, the change or transition from the start of control, which is in the first control mode, to the control in the second control mode is conducted in a short period of time. Under the control in the second control mode, the intake-side phase control valve 41 controls so that the relative rotational phase of the intake-side variable valve timing control apparatus A is changed in the advanced angle direction Sa for advancing an intake timing and enhancing a fuel efficiency. In addition, the exhaust gasses are exhausted at a set timing so that decrease in an efficiency of treating or processing the exhaust gasses is restricted. Specifically, in a case where the operation of the engine E moves to an idling state or the engine E is kept operating in a partial zone, the relative rotational phase of the intake-side variable valve timing control apparatus A is moved in the advanced angle direction Sa. As a result, the fuel efficiency is enhanced without increasing an amount of exhaust gasses.

Next, in a case where it is detected, from a detection signal of the water temperature sensor 56, that the water temperature exceeds a specified value, the lock control valve 43 is set at the third control position T3. Either one or both of the intake-side phase control valve 41 and the exhaust-side phase control valve 42 which needs to be controlled is controlled depending on necessity of the control. Thus, the control moves to the third control mode (Steps S106 to S108).

At the third control position T3, the opening/closing timings of the respective intake valve Va and the exhaust valve Vb are arbitrarily set. As a result, for example, a pumping loss is reduced and/or a volumetric efficiency is enhanced, and thus the engine E is operated efficiently.

It is known that, in a case where the engine E rotates at a low or medium rotational speed, torque and the fuel efficiency are enhanced by reducing a valve overlap period in which the exhaust valve Vb continues to be opened at the timing when the intake valve Va opens. It is also known that, in a case where the engine E rotates at a high rotational speed, higher output is obtained by setting the valve overlap period to be long.

For the above-stated reasons, the relative rotational phases of the intake-side phase control valve 41 and the exhaust-side phase control valve 42 are specified depending on the rotational speed of the engine E.

Figure 12:
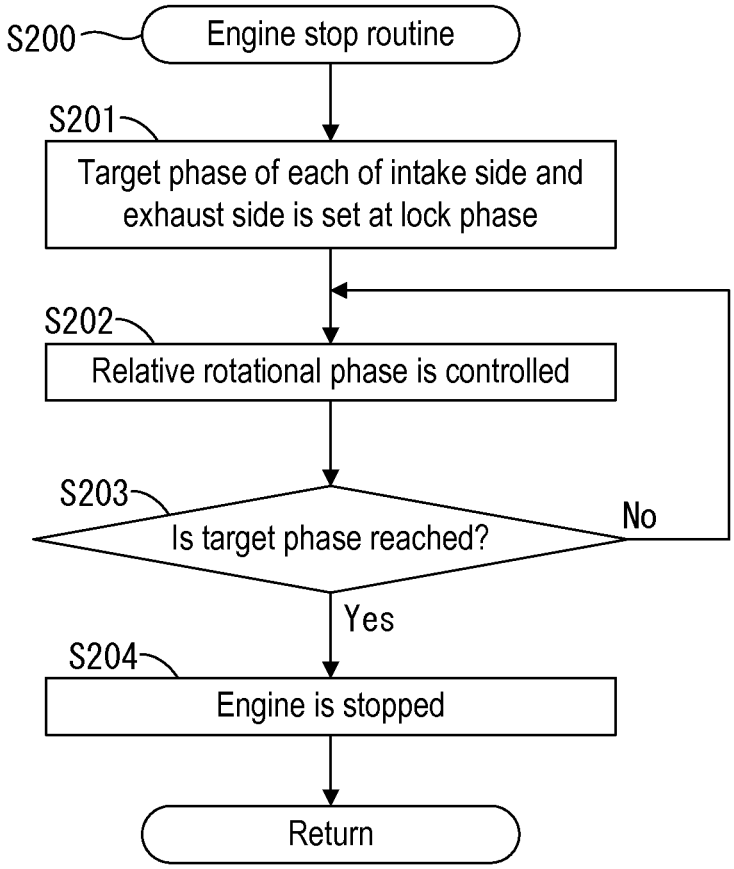
FIG. 12 is a flowchart of an engine stop routine according to the embodiment.

The engine stop routine will be described hereunder. As illustrated in the flowchart in FIG. 12, in the engine stop routine (Step S200), a target phase of each of the intake-side variable valve timing control apparatus A and the exhaust-side variable valve timing control apparatus B is set at the lock phase LS. Thereafter, in a state where a detection signal of the intake-side phase sensor 17 and a detection signal of the exhaust-side phase sensor 18 are being fed back, the relative rotational phases are brought the respective lock phases LS under the controls of the respective intake-side phase control valve 41 and exhaust-side phase control valve 42 (Steps S201 and S202).

Due to the above-described control, in a case where it is detected that the relative rotational phases are moved to the lock phases LS on the basis of the detection signals from the intake-side phase sensor 17 and the exhaust-side phase sensor 18, the lock members 25 are inserted in the respective lock recessed portions LD by the biasing forces of the lock springs 26. Thereafter, the engine E is stopped (Steps S203 and S204).

As described above, the engine E is stopped after the control which makes the lock mechanisms L of the respective intake-side variable valve timing control apparatus A and exhaust-side variable valve timing control apparatus B to reach the locked states. As a result, in the engine start-up routine, the engine E is started in a state where the lock mechanisms L of the respective intake-side variable valve timing control apparatus A and exhaust-side variable valve timing control apparatus B are in the locked states.

Effects and advantages of the present embodiment will be described hereunder. According to the variable valve timing control unit of the present embodiment, the lock control valve 43 is configured to be positioned at the four positions. In a state where the electric power is not supplied to the electromagnetic solenoid 64, the lock control valve 43 is maintained at the first control position T1. Due to this configuration, the electric power does not need to be supplied to the electromagnetic solenoid 64 when the engine E is started up. As a result, the lock mechanisms L of the respective intake-side variable valve timing control apparatus A and exhaust-side variable valve timing control apparatus B are maintained in the locked states without wasting electric power.

In addition, at the start-up of the engine E, the lock mechanisms L of the respective intake-side variable valve timing control apparatus A and exhaust-side variable valve timing control apparatus B are kept in the locked states, and consequently the relative rotational phase of each of the intake-side variable valve timing control apparatus A and the exhaust-side variable valve timing control apparatus B is maintained. As a result, the favorable start-up of the engine E is realized.

The first control position T1, the second control position T2, the third control position T3 and the fourth control position T4 are positioned so as to be arranged in the mentioned order. Accordingly, immediately after the engine E starts up, the operation of setting the control position to the second control position T2 is performed quickly with the supply of a predetermined electric power to the electromagnetic solenoid 64.

After the temperature of the engine E increases up to temperature that is appropriate for the operation, the electric power supplied to the electromagnetic solenoid 64 of the lock control valve 43 is increased, and thus the operation of setting the control position at the third control position T3 is conducted quickly. At the third control position T3, each of the relative rotational phases of the intake-side variable valve timing control apparatus A and exhaust-side variable valve timing control apparatus B is set at an appropriate value that corresponds to the rotational speed of the engine E so that required torque is obtained.

In a case that an air conditioner is turned on when the engine E rotates at a low rotational speed, for example, at idling, the opening/closing timing of the exhaust valve Vb may be moved in the advanced angle direction Sa while the intake valve Va is maintained at the lock phase LS. As a result, vibrations of the engine E may be reduced.

An alternate embodiment will be described hereunder. The aforementioned embodiment disclosed here may be modified as follows.

(a) For example, in a state where the lock mechanisms L of the respective intake-side variable valve timing control apparatus A and exhaust-side variable valve timing control apparatus B are in the locked states, the lock phases may be specified in such a manner that the exhaust valve Vb remains in an opened state at the timing when the intake valve Va starts opening and starts taking air into the combustion chamber. In this case, the lock phase does not need to be the lock phase LS that is described in the aforementioned embodiment and a lock phase may be newly added.

Figure 13:
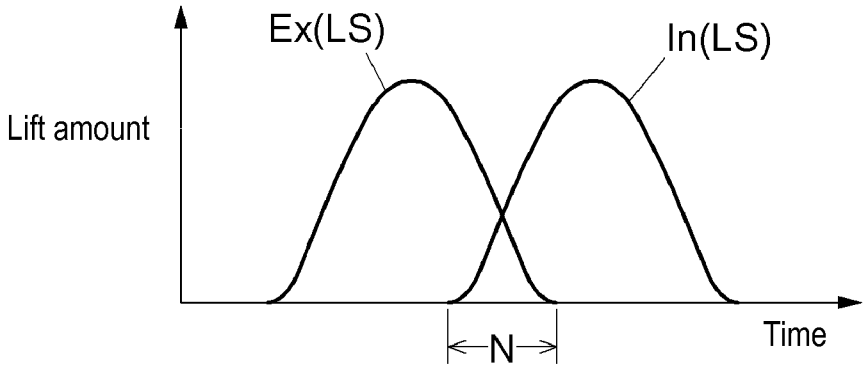
FIG. 13 is a chart illustrating opening/closing timings of respective intake valve and exhaust valve according to an alternate embodiment (a) disclosed here.

In a case where the lock phases LS of the respective intake-side variable valve timing control apparatus A and exhaust-side variable valve timing control apparatus B are specified as in the alternate embodiment (a), a time, that is, passage of time, is shown on a horizontal axis and a lift amount of each of the intake valve Va and the exhaust valve Vb is shown on a vertical axis as illustrated in FIG. 13. As may be understood from FIG. 13, an overlap region N in which an exhaust region Ex and an intake region In overlap with each other is formed at the timing when the intake valve Va opens. Here, the exhaust region Ex corresponds to a region or period in which the exhaust valve Vb opens and the intake region In corresponds to a region or period in which the intake valve Va opens.

By setting the lock phases LS as described above, when the engine E is started up (corresponding to the control in the engine start-up routine of the aforementioned embodiment), the combustion gas can be drawn from the exhaust valve Vb into the combustion chamber at an intake stroke. For example, in a case where the engine E is started up in a cold state, the fuel sprayed from the injector 9 is attached to a low-temperature inner wall of the cylinder and stays thereat, and the residual fuel staying at the cylinder is burned only slightly and is then discharged as unburned HC (unburned hydrocarbon) together with the combustion gas. However, by setting the timing as described above, even when the engine E is started up in the cold state, the unburned fuel is drawn into the combustion chamber via the exhaust valve Vb, and accordingly temperature of the combustion chamber is increased. As a result, vaporization of the fuel that is sprayed from the injector 9 into the combustion chamber is facilitated, thereby assuring the combustion of the fuel, and consequently an amount of emission of the unburned HC is reduced.

(b) As mentioned in the alternate embodiment (a), plural lock phases may be set with the lock mechanism L. Specifically, on a hybrid-type vehicle or an idle stop-type vehicle, a lock phase which is formed when the engine E is automatically stopped is added at a retarded angle-side relative to the lock phase LS of the aforementioned embodiment. In addition, an environmental temperature sensor detecting an outdoor temperature as an environmental temperature is provided at the vehicle, and a lock phase is added at each of an advanced angle-side and the retarded angle-side relative to the lock phase LS of the aforementioned embodiment so that the lock phase, from among the plural lock phases, which is suitable or appropriate for the engine start-up is chosen on the basis of the detected temperature.

According to the above-described configuration where the plural lock mechanisms L are locked at the plural lock phases, the engine stop routine is specified in such a manner that the lock phase is chosen or selected to meet a circumstance in which the engine E is stopped. According to the configuration where the plural lock phases are specified, the engine E may be started at a light load. As a result, the amount of emission of the unburned HC is reduced as described above.

(c) In the aforementioned embodiment, the four operation positions of the lock control valve 43 are set, however, the three operation positions may be set without forming the fourth control position T4 described in the aforementioned embodiment.

(d) The lock control valve 43 may be configured as a rotary-type where a rotary-type valve body is accommodated within a valve case. In this case, by arranging the first control state, the second control state, the third control state and the fourth control state so as to establish a positional relationship where the first control state, the second control state, the third control state and the fourth control state are positioned next to each other in a rotational direction of the valve body, the quick operation of the lock mechanism L is enabled.

INDUSTRIAL APPLICABILITY

The embodiments disclosed here may be applied to the engine (i.e., the internal combustion engine) provided with the intake-side variable valve timing control apparatus and the exhaust-side variable valve timing control apparatus each of which includes the lock mechanism.

According to the aforementioned embodiments, the variable valve timing control unit includes the intake-side variable valve timing control apparatus A and the exhaust-side variable valve timing control apparatus B. Each of the intake-side variable valve timing control apparatus A and the exhaust-side variable valve timing control apparatus B includes the outer rotor 20 which synchronously rotates with the crank shaft 1 of the engine E, the inner rotor 30 arranged coaxially with the outer rotor 20, the lock member 25 which engages from one of the outer rotor 20 and the inner rotor 30 to the other of the outer rotor 20 and the inner rotor 30 for establishing the engaged state of the lock member 25 so that the outer rotor 20 and the inner rotor 30 are in the integral rotation state, the advanced angle fluid passage 34 allowing the supply of the hydraulic fluid to the advanced angle chamber Ca formed between the outer rotor 20 and the inner rotor 30, the retarded angle fluid passage 35 allowing the supply of the hydraulic fluid to the retarded angle chamber Cb formed between the outer rotor 20 and the inner rotor 30, the unlock fluid passage 36 allowing the supply of the hydraulic fluid for releasing the engaged state of the lock member 25, and the inner rotor 30 of the intake-side variable valve timing control apparatus A being connected to the intake cam shaft 7 of the engine E, the inner rotor 30 of the exhaust-side variable valve timing control apparatus B being connected to the exhaust cam shaft 8 of the engine E. The variable valve timing control unit includes the intake-side phase control valve 41 selectively performing the supply and the discharge of the hydraulic fluid relative to the advanced angle fluid passage 34 of the intake-side variable valve timing control apparatus A and relative to the retarded angle fluid passage 35 of the intake-side variable valve timing control apparatus A, the exhaust-side phase control valve 42 selectively performing the supply and the discharge of the hydraulic fluid relative to the advanced angle fluid passage 34 of the exhaust-side variable valve timing control apparatus B and relative to the retarded angle fluid passage 35 of the exhaust-side variable valve timing control apparatus B, and the single lock control valve 43 controlling the supply and the discharge of the hydraulic fluid relative to the unlock fluid passages 36 of the respective intake-side variable valve timing control apparatus A and the exhaust-side variable valve timing control apparatus B.

According to the above-described configuration, the phase control of the intake-side variable valve timing control apparatus A is conducted by the intake-side phase control valve 41, and thus the intake timing may be specified. The phase control of the exhaust-side variable valve timing control apparatus B is conducted by the exhaust-side phase control valve 42, and thus an exhaust timing may be specified. The lock mechanisms L of the respective intake-side variable valve timing control apparatus A and exhaust-side variable valve timing control apparatus B are controlled by the lock control valve 43. That is, the controls of the lock mechanisms L of the respective intake-side variable valve timing control apparatus A and exhaust-side variable valve timing control apparatus B are performed without providing two valves for controlling the respective lock mechanisms L. Consequently, the variable valve timing control unit which may control the opening/closing timings of the respective intake valve Va and exhaust valve Vb independently from each other is configured with a simple structure without increasing the number of parts and components.

According to the aforementioned embodiments, each of the intake-side variable valve timing control apparatus A and the exhaust-side variable valve timing control apparatus B includes the lock mechanism L, and the lock control valve 43 is configured to be set in the first control state in which the lock control valve 43 discharges the hydraulic fluid from the unlock fluid passage 36 of the intake-side variable valve timing control apparatus A and from the unlock fluid passage 36 of the exhaust-side variable valve timing control apparatus B for maintaining each of the lock mechanisms L to be in the locked state.

According to the above-described configuration, by setting the first control state, the relative rotational phases of the respective intake-side variable valve timing control apparatus A and exhaust-side variable valve timing control apparatus B are maintained at the phases that are suitable for the start-up of the engine E even in a case where only a slight amount of hydraulic fluid is supplied from the hydraulic pump P driven by the crank shaft 1 of the engine E, for example, at the start-up of the engine E.

According to the aforementioned embodiments, the lock control valve 43 is configured to be set in the second control state in which the lock control valve 43 supplies the hydraulic fluid to the unlock fluid passage 36 of the intake-side variable valve timing control apparatus A for releasing the locked state at the intake-side variable valve timing control apparatus A and the lock control valve 43 discharges the hydraulic fluid from the unlock fluid passage 36 of the exhaust-side variable valve timing control apparatus B for maintaining the locked state at the exhaust-side variable valve timing control apparatus B.

According to the above-described configuration, for example, in a case where operation of the engine E has moved to the warm-up after the start-up and/or in a case where the engine E is operated in the partial zone, the intake timing of the intake valve Va is advanced by displacing the relative rotational phase of the intake-side variable valve timing control apparatus A in the advanced angle direction Sa. Consequently, the fuel efficiency is enhanced while the exhaust gasses are exhausted at the set timing so that the efficiency of treating or processing the exhaust gasses is prevented from decreasing.

According to the aforementioned embodiments, the lock control valve 43 is configured to be set in the third control state in which the lock control valve 43 supplies the hydraulic fluid to the unlock fluid passage 36 of the intake-side variable valve timing control apparatus A for releasing the locked state at the intake-side variable valve timing control apparatus A and the lock control valve 43 supplies the hydraulic fluid to the unlock fluid passage 36 of the exhaust-side variable valve timing control apparatus B for releasing the locked state at the exhaust-side variable valve timing control apparatus B.

According to the above-described configuration, the locked states of the lock mechanisms L of the respective intake-side variable valve timing control apparatus A and exhaust-side variable valve timing control apparatus B are unlocked, that is, released. Consequently, for example, in a state where the opening/closing timings of the intake valve Va and the exhaust valve Vb can be arbitrarily specified, such as after the warm-up operation of the engine E is completed, the relative rotational phase of the intake-side variable valve timing control apparatus A is displaced in an arbitrary direction and the relative rotational phase of the exhaust-side variable valve timing control apparatus B is displaced in an arbitrary direction. That is, by setting the intake timing of the intake valve Va arbitrarily and setting the exhaust timing of the exhaust valve Vb arbitrarily, the pumping loss is reduced and/or the volumetric efficiency is enhanced, for example.

According to the aforementioned embodiments, the lock control valve 43 is configured to be set in the fourth control state in which the lock control valve 43 discharges the hydraulic fluid from the unlock fluid passage 36 of the intake-side variable valve timing control apparatus A for maintaining the locked state at the intake-side variable valve timing control apparatus A and the lock control valve 43 supplies the hydraulic fluid to the unlock fluid passage 36 of the exhaust-side variable valve timing control apparatus B for releasing the locked state at the exhaust-side variable valve timing control apparatus B.

According to the aforementioned embodiments, in a case where, for example, the air conditioner is operated at idling after the warm-up of the engine E is completed, the vibrations of the engine E may be restricted from occurring or may be reduced.

According to the aforementioned embodiments, the lock control valve 43 includes the valve case 61 and the single spool 62 fitted in the valve case 61 to be movable in a sliding manner relative to the valve case 61, the spool 62 is configured to be positioned at the first control position T1 which establishes the first control state and the second control position T2 which establishes the second control state, and the first control position T1 and the second control position T2 are arranged to be next to each other.

According to the above-described configuration, by setting the spool 62 at the position that corresponds to the first control state (that is, the first control position T1), the engine E is started in the favorable or satisfactory manner. Next, the spool 62 is moved by one position so as to be set at the position that corresponds to the second control state (that is, the second control position T2), and thus the intake timing of the intake valve Va is advanced to enhance the fuel efficiency. That is, in a case where the engine E moves to the warm-up operation, the spool 62 is moved by only one position. As a result, the control states are switched or changed quickly.

According to the aforementioned embodiments, the lock control valve 43 includes the valve case 61 and the single spool 62 fitted in the valve case 61 to be movable in the sliding manner relative to the valve case 61, the spool 62 is configured to be positioned at the first control position T1 which establishes the first control state, the second control position T2 which establishes the second control state, the third control position T3 which establishes the third control state and the fourth control position T4 which establishes the fourth control state, and the first control position T1, the second control position T2, the third control position T3 and the fourth control position T4 are arranged in such a manner that the first control state, the second control state, the third control state and the fourth control state are formed in an order of the first control state, the second control state, the third control state and the fourth control state.

According to the above-described configuration, also in a case where the engine E is operated in the first control state, and thereafter the control state moves to the fourth control state via the second control state and the third control state, the spool 62 is moved sequentially from the position that corresponds to the first control state (that is, the first control position T1) to the position that corresponds to the fourth control position (that is, the fourth control position T4). Accordingly, the controls are switched or changed quickly in an unwasted or economical operation.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control unit comprising:

an intake-side variable valve timing control apparatus;

an exhaust-side variable valve timing control apparatus, each of the intake-side variable valve timing control apparatus and the exhaust-side variable valve timing control apparatus including a driving-side rotation member which synchronously rotates with a crank shaft of an internal combustion engine, a driven-side rotation member arranged coaxially with the driving-side rotation member, a lock member which engages from one of the driving-side rotation member and the driven-side rotation member to the other of the driving-side rotation member and the driven-side rotation member for establishing an engaged state of the lock member so that the driving-side rotation member and the driven-side rotation member are in an integral rotation state, an advanced angle fluid passage allowing supply of fluid to an advanced angle chamber formed between the driving-side rotation member and the driven-side rotation member, a retarded angle fluid passage allowing supply of the fluid to a retarded angle chamber formed between the driving-side rotation member and the driven-side rotation member, an unlock fluid passage allowing supply of the fluid for releasing the engaged state of the lock member, and the driven-side rotation member of the intake-side variable valve timing control apparatus being connected to an intake cam shaft of the internal combustion engine, the driven-side rotation member of the exhaust-side variable valve timing control apparatus being connected to an exhaust cam shaft of the internal combustion engine, the variable valve timing control unit comprising:

an intake-side phase control valve selectively performing supply and discharge of the fluid relative to the advanced angle fluid passage of the intake-side variable valve timing control apparatus and relative to the retarded angle fluid passage of the intake-side variable valve timing control apparatus;

an exhaust-side phase control valve selectively performing supply and discharge of the fluid relative to the advanced angle fluid passage of the exhaust-side variable valve timing control apparatus and relative to the retarded angle fluid passage of the exhaust-side variable valve timing control apparatus; and a single lock control valve controlling supply and discharge of the fluid relative to the unlock fluid passages of the respective intake-side variable valve timing control apparatus and the exhaust-side variable valve timing control apparatus.

2. The variable valve timing control unit according to claim 1, wherein each of the intake-side variable valve timing control apparatus and the exhaust-side variable valve timing control apparatus includes a lock mechanism, and the single lock control valve is configured to be set in a first control state in which the lock control valve discharges the fluid from the unlock fluid passage of the intake-side variable valve timing control apparatus and from the unlock fluid passage of the exhaust-side variable valve timing control apparatus for maintaining each of the lock mechanisms to be in a locked state.

3. The variable valve timing control unit according to claim 1, wherein the single lock control valve is configured to be set in a second control state in which the lock control valve supplies the fluid to the unlock fluid passage of the intake-side variable valve timing control apparatus for releasing the locked state at the intake-side variable valve timing control apparatus and the single lock control valve discharges the fluid from the unlock fluid passage of the exhaust-side variable valve timing control apparatus for maintaining the locked state at the exhaust-side variable valve timing control apparatus.

4. The variable valve timing control unit according to claim 3, wherein the single lock control valve includes a valve case and a single spool fitted in the valve case to be movable in a sliding manner relative to the valve case, the spool is configured to be positioned at a first control position which establishes the first control state and a second control position which establishes the second control state, and the first control position and the second control position are arranged to be next to each other.

5. The variable valve timing control unit according to claim 1, wherein the single lock control valve is configured to be set in a third control state in which the lock control valve supplies the fluid to the unlock fluid passage of the intake-side variable valve timing control apparatus for releasing the locked state at the intake-side variable valve timing control apparatus and the single lock control valve supplies the fluid to the unlock fluid passage of the exhaust-side variable valve timing control apparatus for releasing the locked state at the exhaust-side variable valve timing control apparatus.

6. The variable valve timing control unit according to claim 1, wherein the single lock control valve is configured to be set in a fourth control state in which the lock control valve discharges the fluid from the unlock fluid passage of the intake-side variable valve timing control apparatus for maintaining the locked state at the intake-side variable valve timing control apparatus and the single lock control valve supplies the fluid to the unlock fluid passage of the exhaust-side variable valve timing control apparatus for releasing the locked state at the exhaust-side variable valve timing control apparatus.

7. The variable valve timing control unit according to claim 6, wherein the single lock control valve includes a valve case and a single spool fitted in the valve case to be movable in a sliding manner relative to the valve case, the spool is configured to be positioned at a first control position which establishes the first control state, a second control position which establishes the second control state, a third control position which establishes the third control state and a fourth control position which establishes the fourth control state, and the first control position, the second control position, the third control position and the fourth control position are arranged in such a manner that the first control state, the second control state, the third control state and the fourth control state are formed in an order of the first control state, the second control state, the third control state and the fourth control state.

* * * * *